US006877462B2

(12) United States Patent
Adams et al.

(10) Patent No.: US 6,877,462 B2
(45) Date of Patent: Apr. 12, 2005

(54) SENSORLESS FLAMMABLE VAPOR PROTECTION AND METHOD

(75) Inventors: John T. Adams, Minneapolis, MN (US); Sybrandus B. V. Munsterhuis, Maple Grove, MN (US)

(73) Assignee: Honeywell International Inc., Morristown, NJ (US)

( * ) Notice: Subject to any disclaimer, the term of this patent is extended or adjusted under 35 U.S.C. 154(b) by 80 days.

(21) Appl. No.: 10/339,507

(22) Filed: Jan. 9, 2003

(65) Prior Publication Data

US 2004/0137391 A1 Jul. 15, 2004

(51) Int. Cl.[7] ..... F24H 9/20

(52) U.S. Cl. ..... 122/14.1; 122/14.2; 122/14.22; 122/504

(58) Field of Search ..... 122/14.1, 14.2, 122/14.21, 14.22, 504; 431/67, 73, 75, 346; 236/20 R, 21 R, 21 B

(56) References Cited

U.S. PATENT DOCUMENTS

| | | | |
|---|---|---|---|
| 2,661,798 | A | 12/1953 | Clevenger et al. |
| 3,734,136 | A | 5/1973 | Lefever |
| 4,431,402 | A | 2/1984 | Hamilton |
| 4,976,608 | A | 12/1990 | Hyde |
| 5,937,796 | A | 8/1999 | Sebastiani |
| 5,938,426 | A | 8/1999 | McGehee |
| RE37,745 | E | 6/2002 | Brandt et al. |
| 6,418,882 | B1 | 7/2002 | Trant et al. |

*Primary Examiner*—Jiping Lu
(74) *Attorney, Agent, or Firm*—Gregory M. Ansems

(57) ABSTRACT

A water heater control system that prevents the accumulation and accidental ignition of dangerous quantities of unwanted flammable vapors. The system intermittently generates a spark at a predetermined interval such that if unwanted flammable vapors are present, they are burned in a controlled manner. The system obviates the need for flammable vapor sensors.

19 Claims, 3 Drawing Sheets

SENSORLESS FLAMMABLE VAPOR PROTECTION AND METHOD

BACKGROUND OF THE INVENTION

The device of the present invention pertains to a safety device for preventing the accumulation and unsafe combustion of flammable vapors by a water heater.

The Consumer Product Safety Commission (CPSC) has been working to reduce the risk of injuries and deaths from gas-fired water heaters. One solution involved a redesign of the water heaters to eliminate the ignition of flammable vapors by installing a flame arrestor on the inlet of the burner compartment. The flame arrestor allows the passage of combustible mixtures but prohibits the passage of flames. Thus, when a liquid capable of giving off flammable vapors is spilled under a water heater, the flammable vapors can go into the combustion chamber and the pilot flame inside the burner will ignite the vapors, but the flame arrestor prohibits this flame from going back towards the spilled gas and causing a large explosion. The flame arrestor is a sufficient solution if there is a pilot to light the spilled gas once it makes its way into the combustion chamber.

However, modern water heaters are becoming equipped with electronic ignition systems. These systems use an electronic spark triggered by a signal from a control circuit when the control system determines there is a need for heat. This intermittent system obviates the need for a pilot light but creates new safety concerns related to the accumulation of combustible vapors. During an off cycle, the hot water in a water heater will heat the air in the flue assembly. The air will rise, creating a draft that will draw in makeup air from the surrounding room. If there is a flammable fluid spill anywhere near the water heater, this draft will pull combustible vapors from the spill into the burner compartment. If a sufficient amount of time elapses between ignition events, a dangerous concentration of vapor could accumulate in the combustion chamber. When a demand for heat occurs, the resulting ignition event could trigger a violent explosion in the combustion chamber.

Water heaters that include a power vent exacerbate the drafting problem. A power vent incorporates a blower that can cause vapors from a flammable liquid spill to form and accumulate more quickly.

Solutions to this problem are being developed. One solution is to provide a flammable vapor sensor attached to the water heater that prevents an ignition event if it detects a flammable vapor. These vapor sensors must pass stringent tests including scenarios involving clogged flame arrestors. This solution not only requires relatively expensive flammable vapor sensors, it does not address the issue of vapor evacuation. In the case of a relatively large spill, the vapors could be present long enough to allow the water in the water heater to cool off, depriving the residents of hot water until the spill is either cleaned up or completely evaporates.

There is a need for a solution to the problem presented by electronically ignited water heaters that avoids the aforementioned vapor accumulation problem.

BRIEF SUMMARY OF THE INVENTION

The present invention provides a water heater control system for a water heater with an electronic ignition. The control system includes a feature that prevents the accumulation of flammable vapors in the combustion chamber without using a pilot light or flammable vapor sensors.

The water heater control system includes a timing circuit and an ignitor that causes an ignition spark at a regular, predetermined interval, independent of heat demand. The intermittent spark is used to ignite whatever flammable gasses may have accumulated in the combustion chamber since a previous intermittent spark. The ignitor is appropriately positioned to best accommodate this function. The predetermined interval is preferably about one minute or less, ensuring that any vapors present are burned off in a safe, controlled manner.

DETAILED DESCRIPTION OF THE INVENTION

Figure 1:
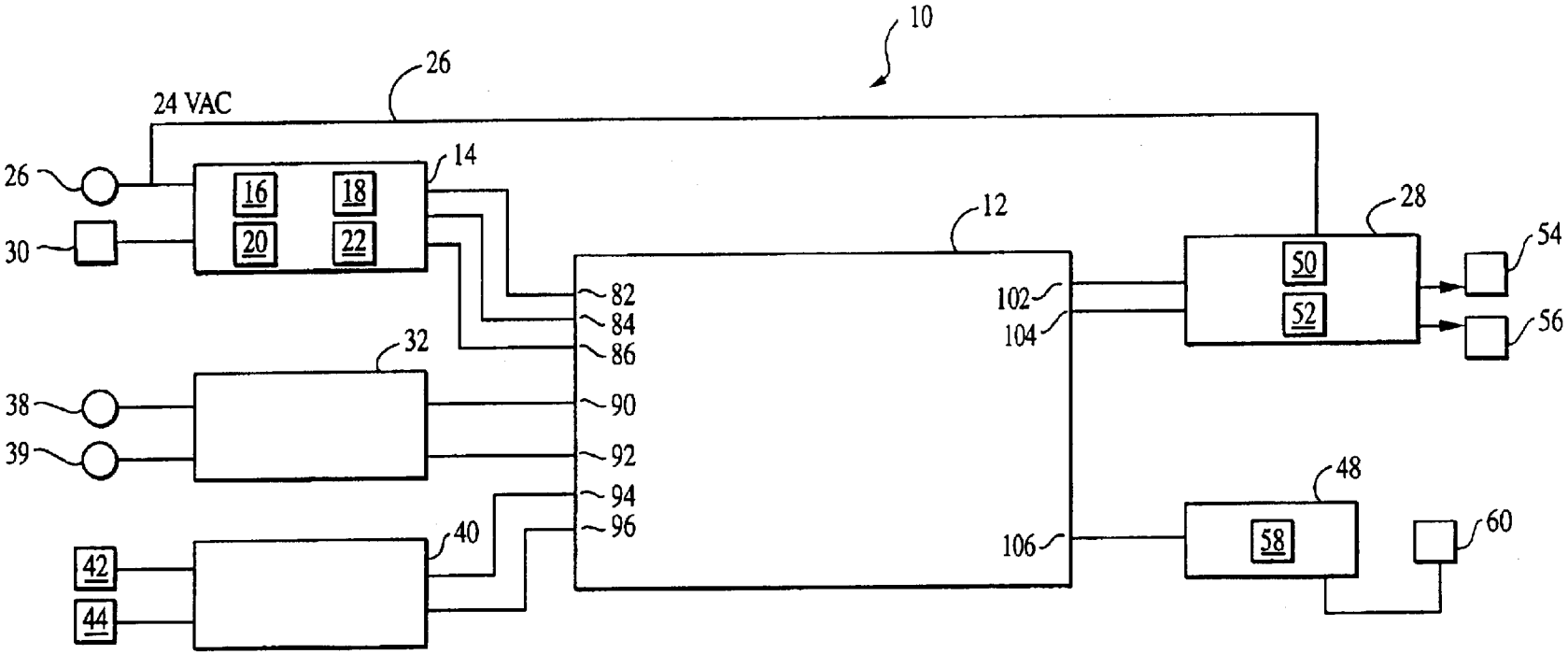
FIG. 1 is a block diagram of the control system of the present invention.

Referring to FIG. 1, there is shown one embodiment of a control system 10 of the present invention. The control system 10 includes a microprocessor 12 which is configured to receive a number of inputs which either provide necessary signals or indicate operating conditions of the water heater. In order to provide more efficient operation, most inputs to the microprocessor 12 are received from various application-specific integrated circuits (ASICs).

For example, an ignition control ASIC 14 has numerous connections to the microprocessor 12. The ignition control ASIC 14 is connected to a power source 26 in order to provide power to the control system 10. The ignition control ASIC 14 includes a power conditioning circuit 16 to condition this power supply and convert it in order to produce all necessary signals used by control system 10. For example, the necessary 5 volt DC power signal used by typical digital circuitry is generated. Furthermore, a 60 Hz square wave is generated in order to provide a timing signal 86 for the microprocessor 10.

The ignition control ASIC 14 is also attached to a flame sensor 30 which is utilized to determine if an existing flame is present in the water heater combustion chamber. The ignition control ASIC 14 has a flame sense conditioning circuit 20 that appropriately conditions the signal from the flame sensor 30 in order to provide a flame sense input 84 to microprocessor 12.

In addition to above-mentioned capabilities, ignition control ASIC 14 further includes a watchdog control circuit 22, which is capable of shutting down power to the control system whenever appropriate signals are not received. More specifically, the watchdog circuit 22 will remove power from the microprocessor 12 in the event that the watchdog circuit 22 does not receive an AC input at a fixed, predetermined frequency, thereby ensuring that the power conditioning circuit 16, and the timing signal 86, are functioning properly. This watchdog function is achieved via watchdog output 82 generated by microprocessor 12.

Also attached to microprocessor 12 is condition sensing circuit 32 which is utilized to detect certain operating conditions. Attached to condition sensing circuit 32 is a pressure sensor 39 and thermal limit switch 38. Thermal limit switch 38 will operate to identify an over-temperature condition. More specifically, once a desired temperature is exceeded, normally-closed thermal limit switch 38 will open, thus signifying a high temperature condition. Condition circuit 32 will then produce a limit input 90 to microprocessor 12 indicating this condition. Similarly, pressure sensor 39 is utilized to determine the presence of air flow into the combustion chamber. A pressure input 92 is provided to microprocessor 12 in order to communicate this information.

An A/D circuit 40 is an ASIC, or alternatively discreet circuit, that receives analog inputs from a tank temperature sensor 42 and a thermostat 44, useable to select a desired temperature set point. The A/D circuit 40 converts these inputs to digital signals 94 and 96, which are useable by the microprocessor 12.

A relay output circuit 28, is attached to the microprocessor 12 and receives outputs 102 and 104 therefrom. The output 102 is a command signaling an induced fan relay 50 to allow 120VAC power (not shown) to be aligned to an induced draft fan 54. The output 104 is a command signaling a gas valve relay 52 to energize a gas valve actuator 56. The relay output circuit 28 acts as a failsafe circuit, allowing the microprocessor 12 to close the gas valve by cutting power to the gas valve relay 52, which removes power from the gas valve actuator 56. This setup also ensures that if the microprocessor 12 loses power for any reason, including by operation of the watchdog circuit 22, the gas valve will close.

A spark generation circuit 48, is attached to microprocessor 12 at spark drive output 106. Spark control circuitry 58 is utilized to operate an igniter 60, in accordance with the operating parameters outlined below.

Figure 2:
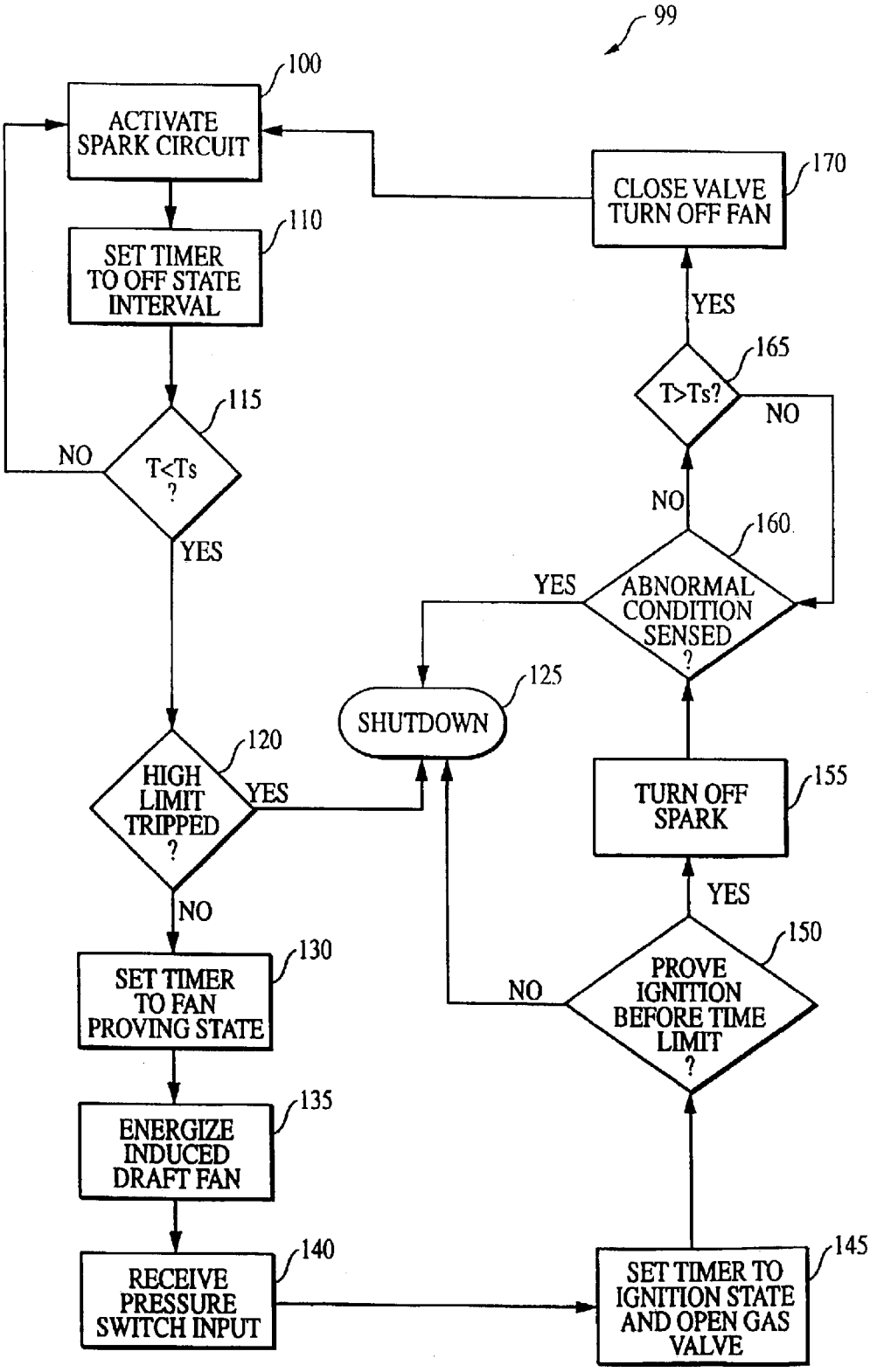
FIG. 2 is a flow chart of a preferred logic sequence followed by the microprocessor of the present invention; and, FIG. 3 is a graph of a preferred interval schedule of the present invention.

Having described the various circuits feeding and receiving signals from the microprocessor 12, it is now possible to detail a preferred logic sequence 99 followed by the microprocessor 12. Looking at FIG. 2, it can be seen that the sequence 99 is a loop. For convenience, description of the sequence will begin at 100 with the first vapor accumulation preventative spark.

Thus, at 100, the spark circuit 48 is activated, causing the capacitor 58 to dump 160 VDC to the spark generator 60, thereby creating a 15 KV spark. Upon creating this spark, the microprocessor 12 resets a timer function that the microprocessor 12 generates using input from a time base circuit 18 of the ignition control circuit 14. The timer function, having been reset, begins measuring the amount of time that has elapsed since being reset.

At this point, the microprocessor 12 has entered the "Off State" of operation, whereby the gas valve 56 is closed and the fan 54 is off. Thus, at 110, the microprocessor 12 sets the timer function to activate the spark circuit 48 at the off state interval. The off state interval is preferably between 10 and 90 seconds, more preferably between 30 and 75 seconds, and even more preferably between 55 and 65 seconds.

While in the off state at 110, the microprocessor 12 checks the inputs 94 and 96 from the A/D circuit 40 to determine whether the temperature T in the water tank has dropped below a temperature Ts selected on the thermostat of the water heater at 115. If T has not dropped below Ts, the logic sequence 99 returns to 100, where the spark circuit 48 continues to be activated according to the off state interval.

If at 115 the temperature T has dropped below Ts, the logic sequence 99 begins preparations for igniting gas burners of the water heater to bring the temperature in the water tank above the desired selected temperature Ts. However, a check is first made at 120 to ensure that the input from the 24 VAC input conditioning circuit 32 does not indicate that the limit switch 38 has tripped. Preferably, tripping this switch 38 at any point in the sequence 99 will cause a shutdown at 125.

If the switch 38 has not tripped at 120, the next step 130 of the sequence 99 is to command the microprocessor 12 to enter a "Fan Proving/Purging State" whereby the timer is set to a faster interval, preferably between 0.5 and 10 Hz, such that a spark is created anywhere from once every couple of seconds, to ten times per second.

With the spark interval increased, next the induced draft fan 54 is energized at 135. The microprocessor 12 energizes the fan 54 by sending an on signal to the fan relay 50 of the relay output circuit 28. The fan relay 50 closes, thereby connecting the fan 54 to 120VAC power (not shown). This step only occurs in the event that the water heater to which the system 10 is attached has an induced draft fan 54.

Next, at 140, the microprocessor waits until it gets an indication from the 24VAC input conditioning circuit 32 that the pressure switch input circuit 36 has changed state, indicating a sufficient draft has been established by the induced draft fan 54. Then, at 145, the microprocessor 12 opens the gas valve 56 by sending an open command to the gas valve relay 52 of the relay output circuit 28. In the event that the water heater is not equipped with a fan 54, a pressure switch circuit 36 is not necessary.

With the gas valve 56 open at 145, and the timer set to fan proving state from step 130, thereby causing a spark at an increased interval, the flame sense amplifier circuit 20 of the ignition control ASIC 14 is used to detect that the sparks have successfully lit the gas at 150. Preferably, when the gas valve is opened, the timer enters an ignition state whereby sparks are generated almost continuously, such as on the order of 10 Hz to 60 Hz. Also, it is preferable that the microprocessor starts a timer at 140, when the gas valve is opened, and establishes a time limit for successful ignition. Thus, as part of the proving ignition step 150, if the timer elapses, indicating a possible problem with the spark circuitry or the gas flow, the gas valve is closed and the spark is turned off as part of the shutdown sequence at 125. If the time limit is not reached, at 155 the spark is turned off once the flame sense amplifier circuit 20 of the ignition control ASIC 14 sends a positive flame sensed signal to the microprocessor 12 indicating that the gas from the gas valve 56 has been successfully lit.

Step 160 of the sequence 90 is provided to clarify that, preferably, the microprocessor 12 is continually looking for abnormal conditions such as a tripped limit switch. If the microprocessor 12 receives an indication that an abnormal condition exists, the system will be shut down at 125 and will not restart until it is serviced.

At 165, the burners remain lit until the temperature T in the water tank exceeds the selected temperature Ts by a predetermined amount. Then, at 170, the microprocessor 12 sends a valve close command to the gas valve relay 52 of the relay output circuit 28, thereby causing the gas valve 56 to close, and the sequence 90 repeats at 100. Additionally, when the valve 56 is closed, the fan is turned off.

It is contemplated that features disclosed in this application can be mixed and matched to suit particular circumstances. For example, the present invention is suitable for use with a system that does not include a force draft fan 54. Water heaters without fans experience a natural draft that is strongest when the heater is in operation. The draft is caused by hot air rising up the flue and drawing cool air into the bottom of the water heater. When the heating cycle is complete and the burner is off, the draft decreases as the temperature in the flue drops. As heat flow between two mediums is proportional to the temperature difference, the draft decreases at an exponential rate. Thus, the present invention can be utilized to provide intermittent sparks after the burner goes into an off state between heating periods. Preferably, the interval between sparks grows at an exponentially decreasing rate, until the next heating cycle commences.

Figure 3:
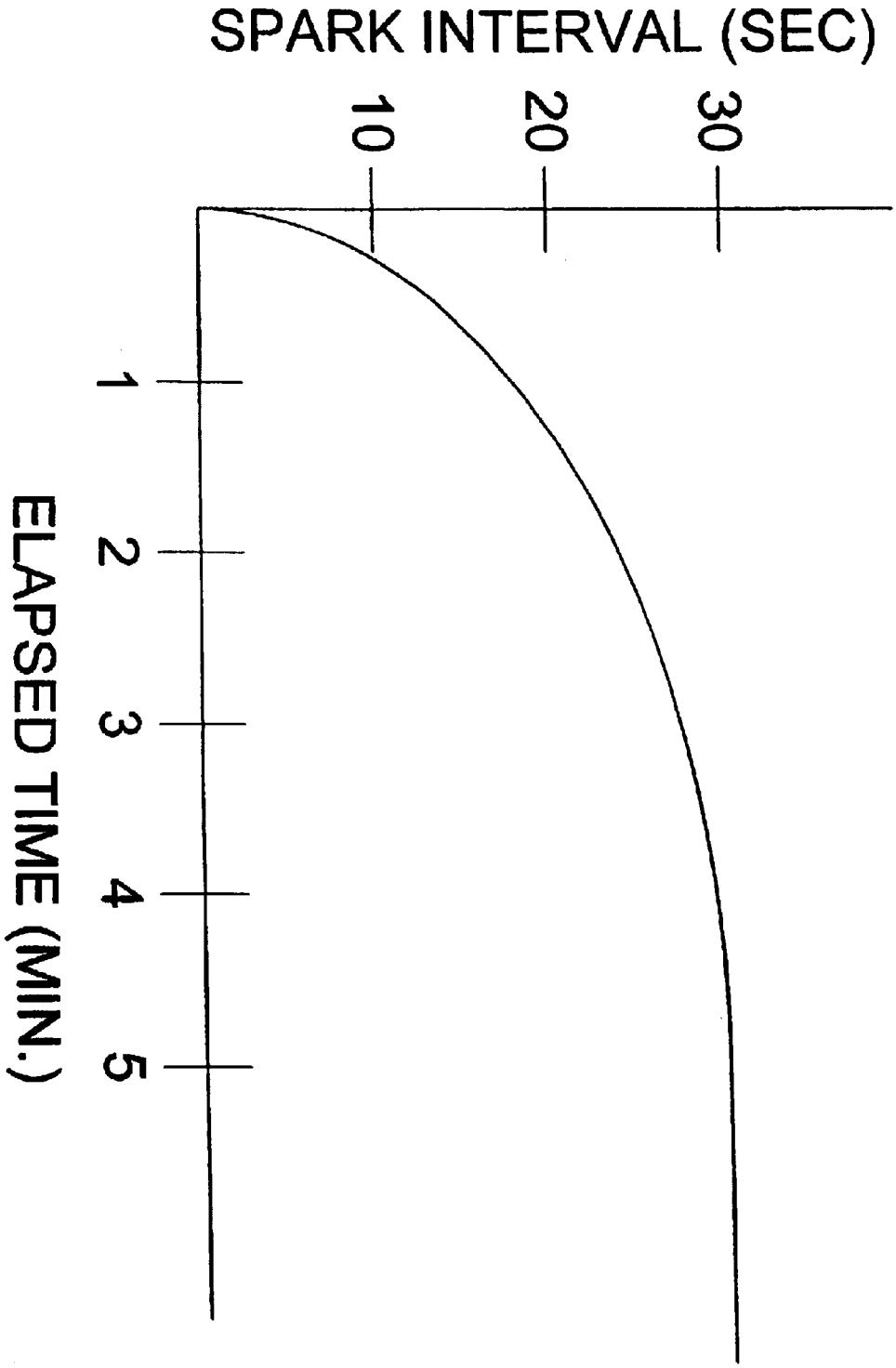

For example, the draft flow rate decreases at a rate that causes it to be reduced by 63% of its original rate after a first time constant passes, 86% after the second time constant, 95% after the third time constant, 98% after the fourth time constant, and nearly 100% after the fifth time constant. So, if it is determined that a spark should occur every 30 seconds as a precautionary measure regardless of flow, then a 30 second interval should be achieved by the fifth minute after a heating cycle. Following the aforementioned curve, the spark schedule shown in FIG. 3 might be appropriate.

Various other modifications and changes will be apparent to those of ordinary skill in the art without departing from the spirit and scope of the present invention. Accordingly, reference should be made to the claims to determine the scope of the present invention.

What is claimed is:

1. A water heater control system comprising:

a microprocessor operably connected to:

a heat source generator, a gas valve;

a time base circuit;.

a watchdog circuit;

an actual temperature sensor usable to sense water temperature in a water tank;

a desired temperature selector; and, a memory storage medium having stored thereon a plurality of instructions which, when executed by the microprocessor, causes the microprocessor to:

compare a temperature sensed by the actual temperature sensor to a temperature setting of the desired temperature selector;

open the gas valve when the sensed temperature falls below the desired temperature setting by a predetermined amount;

energize the heat source generator when the gas valve is opened;

close the gas valve when the sensed temperature exceeds the desired temperature setting by a predetermined amount; and, intermittently energize said heat source generator at predetermined intervals when said gas valve is closed.

2. The water heater control system or claim 1 wherein said predetermined intervals are 10 to 90 seconds.

3. The water heater control system of claim 1 wherein said predetermined intervals are 30 to 75 seconds.

4. The water heater control system of claim 1 wherein said predetermined intervals are 55 to 65 seconds.

5. The water heater control system of claim 1 further comprising a relay operably connecting said microprocessor to said gas valve.

6. The water heater control system of claim 1 further comprising a failsafe circuit operably connecting said microprocessor to said gas valve such that said microprocessor may command a shutdown whereby said gas valve is closed.

7. The water heater control system of claim 1 wherein said microprocessor is further operably connected to an induced draft fan, and said plurality of instructions, when executed by the microprocessor, further causes the microprocessor to energize the induced draft fan if the sensed temperature falls below the desired temperature setting by a predetermined amount, before causing the gas valve to open.

8. The water heater system of claim 7 further comprising a relay operably connecting said microprocessor to said induced draft fan.

9. The water beater system of claim 1 wherein said watchdog circuit is operably connected to said microprocessor such that said watchdog circuit requires an AC input at a predetermined frequency, else said watchdog circuit removes power from said microprocessor, thereby resulting in a shutdown of said water heater system.

10. The water heater control system of claim 1 wherein said predetermined intervals are increasing at an exponentially decreasing rate after the gas valve is closed.

11. A water heater control system comprising:

a first means for electrically igniting a flammable vapor; and, a second means, operably connected to the first means, for activating the first means;

wherein the second means is constricted and arranged to activate the first means whenever a demand for heat exists;

wherein the second means is further constructed and arranged to intermittently activate the first means according to a predetermined interval schedule whenever a demand for heat doesn't exist such that any existing unwanted flammable vapors are ignited;

wherein said predetermined interval schedule includes at least two different intervals when the system is used on a water heater having a draft fan, such that a first interval is used when said fan is off and a second interval, faster than the first interval, is used when said fan is on; and, wherein said predetermined interval schedule includes an exponentially varying interval for use on a water heater without a draft fan whereby the interval grows at an exponentially decreasing rate beginning when the demand for heat ends.

12. The water beater control system of claim 11 wherein said first means comprises a spark generator.

13. The water heater control system of claim 11 wherein said first means comprises a heating element.

14. The water heater control system of claim 11 wherein said second means comprises a microprocessor.

15. The water heater control system of claim 11 wherein said first predetermined interval is 10 to 90 seconds.

16. The water heater control system of claim 11 wherein said first predetermined interval is 30 to 75 seconds.

17. The water heater control system of claim 11 wherein said first predetermined interval is 55 to 65 seconds.

18. The water heater control system of claim 11 wherein said second predetermined interval is $1/10^{th}$ to 2 seconds.

19. The water heater control system of claim 11 wherein the exponentially varying interval grows at an exponentially decreasing rate beginning with relatively continuous when the demand for heat ends and becomes steady at 30 seconds after five minutes.

* * * * *